US005356707A

United States Patent [19]

McCullough, Jr. et al.

[11] Patent Number: 5,356,707

[45] Date of Patent: Oct. 18, 1994

[54] NON-LINEAR CARBONACEOUS FIBER

[75] Inventors: Francis P. McCullough, Jr., Lake Jackson, Tex.; Bhuvenesh C. Goswami, Clemson, S.C.; Stephen E. Hill, Angleton, Tex.

[73] Assignee: The Dow Chemical Company, Midland, Mich.

[21] Appl. No.: 26,928

[22] Filed: Mar. 5, 1993

[51] Int. Cl.[5] ..... D02C 3/00

[52] U.S. Cl. ..... 428/367; 428/369; 428/371; 264/29.2

[58] Field of Search ..... 428/364, 369, 371, 367; 423/447.1, 447.2; 264/29.2

[56] References Cited

U.S. PATENT DOCUMENTS

| | | | |
|---|---|---|---|
| 4,005,183 | 1/1977 | Singer | 423/447.2 |
| 4,401,588 | 8/1983 | Turner | 423/447.2 |
| 4,642,664 | 2/1987 | Goldberg et al. | 423/447.2 |
| 4,950,533 | 8/1990 | McCullough, Jr. et al. | 428/369 |
| 4,957,807 | 9/1990 | McCullough | 428/369 |
| 4,977,023 | 12/1990 | Krupp et al. | 423/447.2 |
| 4,979,274 | 12/1990 | McCullough | 28/278 |

*Primary Examiner*—Patrick J. Ryan
*Assistant Examiner*—N. Edwards

[57] ABSTRACT

The present invention resides in ignition resistant non-linear carbonaceous fiber or fiber tow having a reversible deflection ratio equal to or less than 1.2:1. The fibers have a multiplicity of crimps along their length with a crimp frequency on the order of from 6 to 15 crimps per inch. Fibers of the invention have improved elongatability of from about 2 to about 9%, a pseudo-elongatability of from about 0.2 to about 18%, and a tenacity without a loss of elongation on the order of at least 6 g/d. The carbonaceous fibers can be used, for example, as thermal insulation and/or fire resistant insulation in vehicles, building structures or clothing in furniture coverings, carpets, and the like, and can be blended with other fibers to form fine yarns.

9 Claims, 2 Drawing Sheets

NON-LINEAR CARBONACEOUS FIBER

FIELD OF THE INVENTION

The present invention relates to a novel fire resistant carbonaceous fiber or tow of fibers having improved processability. More particularly, the invention resides in a non-linear, fire resistant fiber or tow of fibers having a multiplicity of crimps with a reversible deflection ratio equal to or less than 1.2:1. The fiber or fiber tow has improved physical characteristics with an elongatability of from at least about 2 to about 9%, a pseudo-elongatability of from about 0.2 to about 18%, and a tenacity of greater than about 6 13g/d.

BACKGROUND OF THE INVENTION

The prior art discloses the manufacture of non-linear carbonaceous fibers having a reversible deflection ratio of greater than 1.2:1 and derived from polymeric compositions such as polyacrylonitrile (PAN). The polymeric material is spun into fibers and can be collected into multifiber assemblies, such as fiber tows containing more than 1000 (1K) individual fibers, that are thereafter oxidatively stabilized. Small tows generally contain from about 1K to 20K fibers, heavy tows contain more than 40K. The fibers or fiber tows can thereafter be formed into a knitted fabric which is then heat treated in a non-oxidizing atmosphere while the fibers are in a relaxed and unstressed condition. Heat treating the fibers increases the carbon content to form carbonaceous fibers which are substantially heat set. The fabric can then be deknitted to form non-linear fiber tows which can then be further processed, as by carding, to form a wool like fluff.

Non-linear carbonaceous fibers and the process of manufacture is disclosed in U.S. Pat. No. 4,837,076 of McCullough et al. These prior non-linear carbonaceous fibers have the disadvantage of difficult processability in forming spun yarns in that they cannot easily be formed into slivers (a continuous strand of loosely assembled fibers without twist) after carding and in subsequent drawing operations without a substantial amount of fiber breakage due to the relatively lower elongatability of the fiber. Moreover, such fibers are difficult to spin into fine yarn especially when they are blended with other synthetic or natural fibers due to the nature of their crimps. Although the crimps in the fiber are necessary for good processability, the relatively large amplitude and low frequency of the crimps in the prior art fibers causes excessive fiber breakage during carding and drawing. In addition, the prior art fibers exhibit poor cohesiveness and sacrifice elongatability to improve tenacity.

Stuffer box crimping and traditional gear crimping, which is commonly used in fiber processing, results in sharp V-type bends in the fiber wherein the outer portion of the fiber bend is subject to severe stress and the underside of the bend is subject to severe compression. These sharp bends therefore provide severely weakened portions in the fiber by causing cracking (on the outer fiber portion), creasing (on the inner fiber portion), or fibrillation. Accordingly, any defective portions of the fiber, when subjected to a bending strain, will lead to breakage at the defective portions of the fiber, especially with fibers that exhibit a greater rigidity or stiffness such as will occur in fibers that are heat treated at a higher temperature, resulting in an increase in the carbon content of the fiber.

In an article by Hall et al entitled, "Effects of Excessive Crimp on the Textile Strength and Compressive Properties of Polyester Fibers," in Journal of Applied Polymer Science, Vol 15 pp. 1539–2544 (1971), the authors describe the detrimental effects of forming sharp crimps in polyester fibers as well as other man made fibers. The authors report that excessive crimping, such as is found in V-type crimps, leads to surface damage of the fiber and a reduction in tenacity and other physical properties, e.g. elongatability which leads to fiber breakage when the fiber is placed under tension.

U.S. Pat. Nos. 4,979,274 and 4,977,654 to McCullough et al disclose apparatuses for crimping and permanently heat setting fibers without placing stress or strain on the fibers. However, the apparatuses do not produce nonlinear fibers having a reversible deflection ratio that is equal to or less than 1.2:1.

The term "reversible deflection ratio" as used herein generally applies to a helical or sinusoidal compression spring. Particular reference is made to the publication, "Mechanical Design—Theory and Practice", MacMillan Publ. Co., 1975, pp. 719 to 748: particularly Section 14-2, pages 721 to 724.

The term "permanent" or "irreversibly heat set" used herein applies to nonlinear fibers which have been heat treated under the conditions as set forth hereinafter until they possess a degree of resiliency and flexibility such that the fibers, when stretched and placed under tension to a substantially linear shape, but without exceeding the tensile strength of the fibers, will revert substantially to their original non-linear shape once the tension on the fibers is released. The foregoing terms also imply that the fibers are capable of being stretched and released over many cycles without breaking the fibers.

The term "fiber structures" herein applies to a multiplicity of filaments that are in the form of a yarn, a wool like fluff or batting, nonwoven fibers that are assembled into a web or felt, a knitted or woven cloth or fabric, or the like.

The term "crimp" as used herein refers to the waviness or nonlinearity of the fiber or fiber tow, as defined in "Man Made Fiber and Textile Dictionary" by Celanese Corporation. The term crimp includes different nonlinear configurations such as, for example, sinusoidal, coil like, and the like. In accordance with a further development of the present invention, the crimp can be a combination of two or more geometric or nongeometric configurations where one crimp is superimposed upon another crimp. For example, a complex crimp can be one in which a lower frequency crimp is superimposed upon a higher frequency crimp.

"Pseudoextensibility" refers to the elongation of a fiber, without placing the fiber under stress, in which the fiber still exhibits a residual non-linear configuration and/or false twist.

The term "uniform diameter" as used herein relates to the diameter of the fiber as drawn prior to crimping. The fiber may contain slight variations or imperfections which commonly occur during normal fiber processing operations.

The term "bending strain" of the fiber as used herein is as defined in Physical Properties of Textile Fibers., W. E. Morton and J. W. S. Hearle, The Textile Institute, Manchester, 1975, pages 407–409. The percent bending strain on a fiber is determined by the equation:

$$R=(r/R)\times 100$$

where S is the percent (%) bending strain, r is the fiber radius, and R is the radius of curvature of bend in terms of the the crimp. That is, if the neutral plane remains in the center of the fiber, the maximum percentage tensile strain, which will be positive on the outside and negative on the inside of the bend, equals $(r/R)\times 100$ in a circular cross-section of the fiber.

The term "carbonaceous fiber" is understood to mean that the carbon content of the polymeric precursor fiber has been increased as a result of an irreversible chemical reaction (cross linking) of the polymer during heat treatment.

The term "cohesion" or "cohesiveness" refers to the force which holds fibers together during yarn manufacture or processing. It is a function of the type and amount of lubricant used on the fiber and the fiber crimp.

SUMMARY OF THE INVENTION

According to one embodiment, the present invention provides a nonlinear fire resistant carbonaceous polymeric fiber or tow of fibers having a reversible deflection ratio that is equal to or less than 1.2:1.

According to another embodiment, the invention provides for a nonlinear fire resistant polyacrylonitrile based carbonaceous fiber or tow of fibers, said fiber having a reversible deflection ratio equal to or less than 1.2:1.

The present invention further provides for a fibrous structure employing the nonlinear fire resistant carbonaceous fibers of the invention.

The present invention also resides in a blend of the nonlinear fire resistant carbonaceous fibers of the invention with natural or synthetic fibers.

Advantageously, the fibers of the invention are provided with crimps along their length with a frequency of from about 6 to about 15 crimps per inch (236 to 590 crimps per met.), preferably from 9 to 12 crimps per inch (354 to 472 crimps per met.). A high crimp frequency, i.e. a relatively larger number of crimps per inch, increases the cohesiveness and interengagement between the individual fibers in a yarn and aids in reducing fiber breakage during processing. In addition, there is an improved cohesiveness between the carbonaceous fibers with a relatively higher crimp frequency when blended with other fibers or when formed into a yarn with similar fibers.

The fibers of the invention can also be provided with a complex crimp in which a first crimp of a relatively low frequency is imposed upon a fiber having a crimp of a relatively high frequency. For example, a fiber or fiber tow can be provided with a crimp having a frequency of 15 crimps per inch. The same crimped fiber is then subjected to a secong crimping operation in which a crimp having a frequency of, for example, 6 crimps per inch is superimposed on the first crimp. It will be apparent that the fiber or fiber tow can also be provided with a crimp of a relatively low frequency, followed by a crimp having a relatively high frequency.

Preferably, the fibers of the invention have an elongatability of from at least about 2 to about 9%, a pseudo-elongatability of from about 0.2 to about 18%, preferably from about 0.2 to about 10%, and a bending strain value of less than 50%, preferably less than 30%. Carbonaceous fibers derived from PAN precursor fibers preferably have a tenacity of at least 6 g/d., an elongatability of from about 3.5 to about 4.5%, and a pseudo-elongatability of from about 0.2 to about 18%.

According to another embodiment of the invention, there is provided an improvement in the physical characteristics of the nonlinear carbonaceous fiber or tow of fibers of the invention. It has been surprisingly discovered that a slight modification in the heat treatment step in preparing the carbonaceous fiber or tow of fibers produces fibers having improved tenacity without any substantial loss in elongatability. That is, by providing a dynamic flow of an inert gas that is directed against the fiber or fiber tow during the heat treatment step, the nonlinear fibers thus produced exhibit a greater tenacity and elongation to break. This treatment has not been disclosed in prior art manufacture of linear or non-linear polymeric fibers which are heat treated at similar elevated temperatures.

The nongraphitic carbonaceous fibers of the invention are useful for the preparation of fiber structures such as, for example, tufted or woven covering for furniture, carpets, wall coverings, fabrics of fine yarn, and the like, all of which exhibit a substantially increased ignition resistance as compared to non-carbonaceous fibers.

It is therefore a primary object of the invention to provide a carbonaceous fiber with a high frequency crimp having a lower reversible deflection ratio than that taught in the prior art. The deflection ratio being equal to or less than 1.2:1.

It is another object of the invention to provide a carbonaceous fiber having improved tenacity, elongatability and processability.

It is also an object of the invention to blend the improved carbonaceous fiber of the invention into fine yarns.

It is yet another object of the invention to incorporate the improved carbonaceous fiber of the invention into thermal insulation and/or ignition resistant structures.

It is a further object of the invention to provide a polyacrylonitrile based precursor material in the manufacture of the carbonaceous fibers or fiber tow of the invention.

It is a further object of the invention to employ the carbonaceous fiber of the invention in the manufacture of fiber structures that are lightweight, resilient, and compressible. Additionally, yarn made with the carbonaceous fiber of the invention has good shape and volume retention and is stable to numerous compression and unloading cycles without breakage of the fibers.

These and other objects and advantages will be better understood from the following detailed description of the invention and drawings.

DESCRIPTION OF THE PREFERRED EMBODIMENTS

Figure 1:
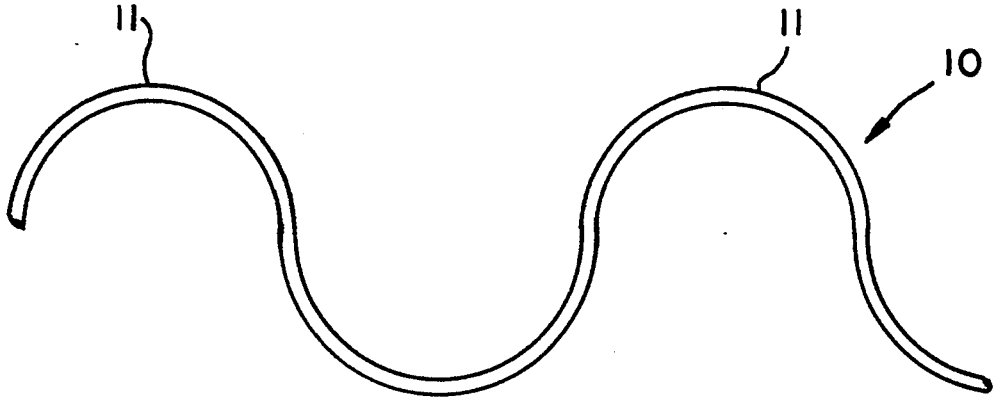
FIG. 1 is a schematic illustration of a non-linear carbonaceous fiber having a relatively large frequency, it being understood that the fiber represented in the drawing is shown at an enlarged scale and that the frequency of the fiber is of a similarly enlarged scale for illustrative purposes.

As seen in FIG. 1 there is a non-linear carbonaceous fiber 10 having crimps 11 which is prepared according to the process described in U.S. Pat. No. 4,837,076. Although the frequency of the fiber is greatly exaggerated in FIG. 1, it graphically illustrates a fiber having a relatively large or low frequency and a corresponding relatively large reversible deflection ratio of greater than 1.2:1. Although such a fiber is entirely suitable for making bulky yarns, it can not be used in the manufacture of fine yarns that are used in many other fiber structures such as fabrics, and the like, because of the low frequency of the crimps which makes the fiber difficult to process, especially when the fiber is blended with other fibers, thus resulting in a poor cohesiveness of the blended fibers. Therefore, the application of these low frequency fibers cannot be extended for use in fibrous structures which call for fine yarns.

Figure 2:
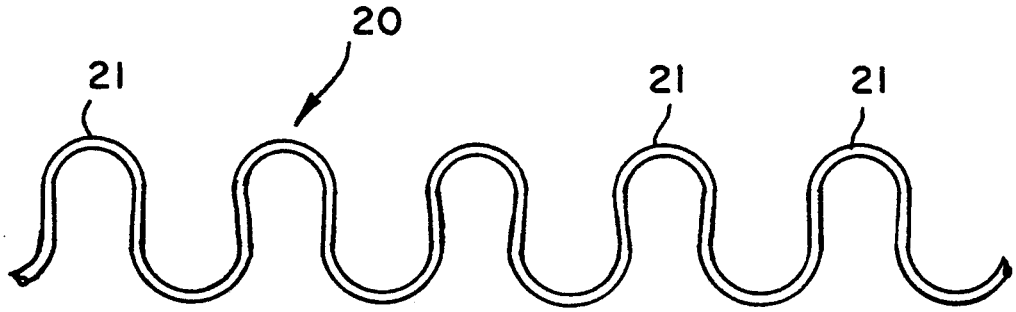
FIG. 2 is a schematic illustration of a non-linear carbonaceous fiber which is more representative of the invention in showing a substantial increase in the frequency or waviness of the fiber.

FIG. 2 illustrates a preferred carbonaceous fiber 20 of the invention. Here again, the frequency of the fiber is greatly exaggerated but it graphically illustrates a fiber having a relatively small or high frequency and a corresponding relatively lower reversible deflection ratio which is equal to or less than 1.2:1.

In a preferred embodiment, the polymeric precursor material that is used in the manufacture of the carbonaceous fiber of the invention is an acrylic polymer, i.e. polyacrylonitrile (PAN). Carbonaceous fibers made from PAN fibers in accordance with the procedure of the invention exhibit an elongatability of from about 2 to about 9%, a pseudoelongatability (due to the crimp) of from about 0.2 to about 18%, preferably from about 0.2 to about 10%, and a reversible deflection ratio which is equal to or less than 1.2:1, preferably from about 0.2:1 to about 1:1. As a result of the relatively higher frequency of crimps, the fiber has improved cohesiveness with the same or different fibers when preparing yarns.

Preferably, the carbonaceous fibers of the invention have a tenacity of at least 6 g/d, preferably from about 6 to about 13 g/d, and from about 13 to about 19 g/d. These preferred fibers generally have an elongation to break of from about 3.5 to about 4.5%.

In contrast, a polyacrylonitrile based carbonaceous fiber formed according to the prior art process that has been heat treated for 1.5 minutes at a temperature of about 650° C. has a tenacity of from about 4 to about 5 g/d and an elongation to break of from about 2 to about 3%.

Advantageously, the fibers of the invention have a bending strain value of less than 50%, preferably less than 30%.

The carbonaceous fibers of the invention are nonflammable and ignition resistant and when blended with other fibers in an amount of as little as about 7.5% also provide an improved ignition resistance for the blend or structure employing the blend.

For processability, a fiber with at least 6 to 15 crimps per inch provides the fiber with flexibility at stress points so as to avoid fiber breakage and greatly improves the frictional forces between the fibers as well as fiber to fiber cohesion. The relatively higher frequency of crimps is an important factor in good fiber cohesiveness when forming yarns.

Figure 3:
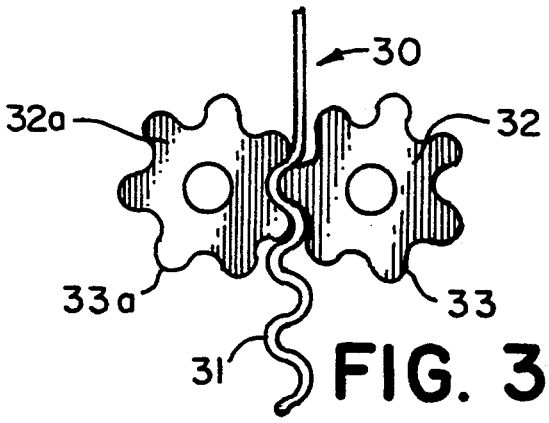
FIG. 3 is a schematic illustration of a crimp forming sprocket wheel mechanism which can be used to prepare the fibers of the invention.

FIG. 3 illustrates a method of providing a tow 30 with a multiplicity of crimps 21 prior to substantially permanently heat setting the crimps by a subsequent heat treatment which increases the carbon content of the fiber. As shown, the tow 30 passes between a pair of noncontacting wheels 32, **32*a* which preferably have rounded teeth or elongated ribs 33, 33*a***. The gears are spaced from each other by a distance sufficient to allow the fiber or fiber tow to enter the spaces between the teeth or ribs without the application of a tensil or compression force on the fiber or tow, thereby avoiding the formation of sharp V-shaped crimps, fibrillation, or other extrusion or compression damage that result in an undesirably low bending strain or outright breakage of the fiber.

Advantageously, the crimped portion of the fiber does not have more than a 15 percent variation from the fiber diameter prior to crimping, preferably not more than 5%. Under carefully controlled conditions the crimped portion is substantially free of any measurable variations in diameter.

One method of forming the crimped fibers of the present invention is to utilize a constant indexing crimp forming device which does not apply a bending strain on the fibers of more than 50%. The crimp forming device comprises a pair of floating, non-contacting wheels 32, **32*a* which form the crimp as the teeth or ribs engage the fiber or fiber tow. In addition, an antibacklash assembly (not shown) is provided which drives each of the wheels 32, 32*a* in constant synchronization and transfers the torque from the teeth of one wheel through the fibers to the teeth of the other wheel while compensating for any variable spacing between the wheels 32, 32*a*. Accordingly, a crimp 31 is formed without fiber breakage or the formation of V-shaped crimps since the teeth 33, 33*a*** do not come into contact with each other and do not apply any damaging stress, compression or other shape distortion on the fiber or fiber tow, regardless of the size of the fiber or fiber tow employed. The fibers are then heat treated so as to form the carbonaceous fibers of the invention and to substantially permanently heat set the crimps as disclosed in U.S. Pat. No. 4,837,076.

Figure 4:
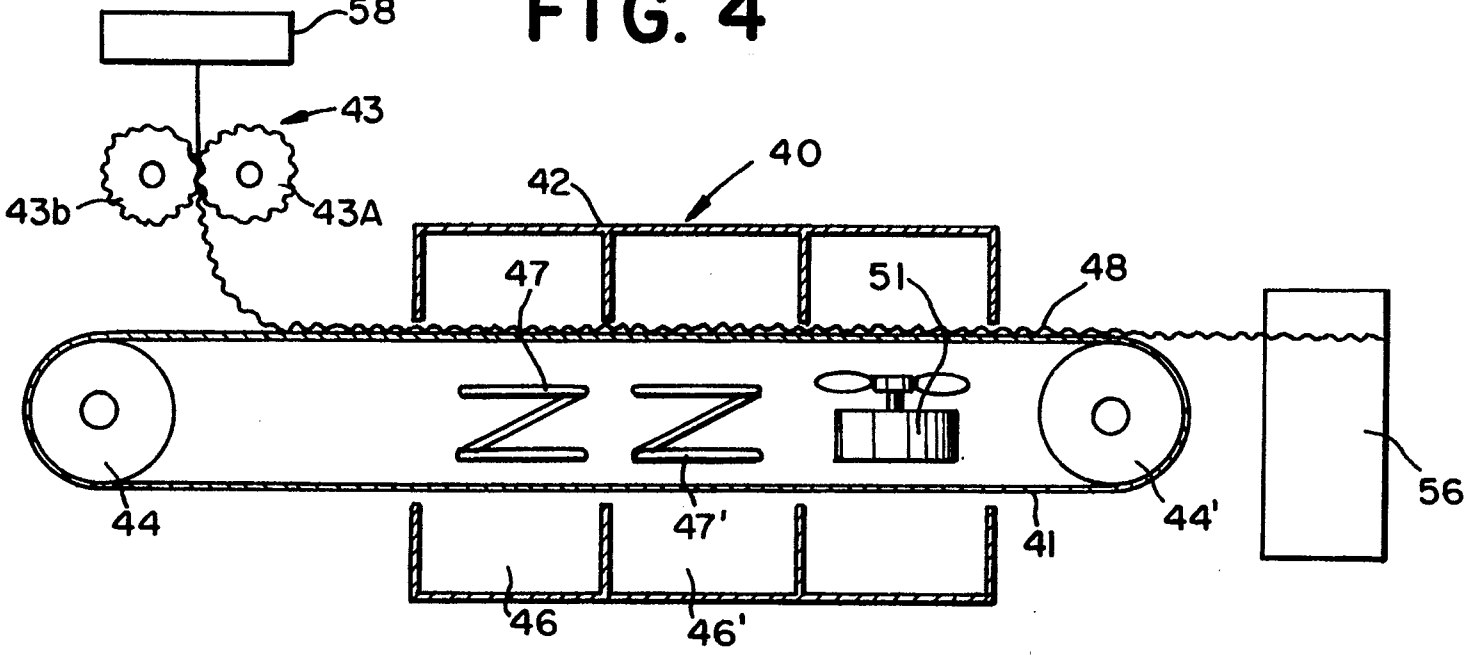
FIG. 4 is a greatly simplified side elevational view of an apparatus for heat treating the crimped polymeric precursor fibers to manufacture the heat set carbonaceous fiber of the invention.

The apparatus is more clearly shown in FIG. 4 where a fiber or fiber tow 48 is delivered from a supply roll 58 to a crimper mechanism 43 comprising a pair of opposed crimping wheels 43A, 43B. The crimping wheels 43A, 43B can be heated to impart a temporary heat set to the fiber sufficient to hold the crimp while the fiber or fiber tow is positioned on a conveyor having a movable belt 41 which is trained around a pair of wheels 44 and 44' one of which is driven at a constant speed by a motor or other drive mechanism, not shown. After the fiber or tow 48 is placed onto the conveyer belt 41, it is transported into a housing or enclosure 42 without imparting any stress or tension on the fiber while maintaining its crimped (but not substantially heat set) configuration. The housing 42 may consists of one or more heating chambers 46A, 46B which are preferably provided with air locks to prevent the ingress of air into the heating chambers and/or the flow or egress of an inert atmosphere out of the chambers, where the inert atmosphere is maintained at a positive pressure in the chambers. Where a pre-oxidized or stabilized polymeric precursor fiber or tow 18 is being heat set, the heating chambers 46A, 46B are conventionally filled with an inert gas. Heat setting of the fiber or tow 48 is conducted by means of heaters 47, 47' and under heating conditions such as described in U.S. Pat. No. 4,837,076 to arrive at fibers or tows with the desired degree of carbonization.

The nonlinear fiber or tow 48 which is substantially permanently heat set in chambers 46A, 46B, preferably after having been provided with a temporary crimp, is then cooled in chamber 50 by cooling means 51 and carried out of the housing 40 to be taken up on roll 56. The speed of rotation of the conveyor rolls 44, 44' is synchronized with the speed of rotation of the crimping wheels so that the fiber or tow placed on the conveyor belt 41 is not placed under stress or tension while passing through the heating chambers 46A, 46B.

The fibers are heat treated in an inert atmosphere such as, for example, nitrogen, argon, helium, hydrogen, or mixtures thereof. The heating zone can be a single or multigradient temperature furnace comprising a number of heating zones that can be maintained at different temperatures.

Preferably, the inert gas is injected into at least one of the heating chambers of the housing so that it comes into intimate or forced contact with the fiber or tow of fibers. A dynamic flow of the inert gas can be provided by, for example, one or more jet nozzles 49 extending into the housing at predetermined positions, rather than merely providing a static inert atmosphere in the housing through which the fibers pass, as is conventionally performed. It is believed that any interstitial oxygen or off-gases which are produced during heating of the polymeric precursor fiber are driven from the fiber, thereby improving the physical characteristics of the fiber. By this procedure the occurrence of side reactions on the fibers are believed to be avoided, thereby producing a fiber with improved tenacity.

The inert gas is applied to the fiber or tow of fibers passing through the heating chambers from the jet 49 at a rate of from about 1.3 to about 39 $ft^3$/min., preferably from about 10 to about 15 $ft^3$/min. The inert gas is applied so that, preferably, it passes over and between the fibers or fiber tow in a transverse flow direction or at an acute angle with respect to the movement of the conveyor belt. It will be appreciated, that the gas can also flow in a direction coincident with the direction of movement of the fiber or fiber tow as long as the gas flow is sufficiently dynamic to contact the fibers and to carry away any off gases that are generated during heating of the fiber. The heating chamber is provided with an exhaust opening (not shown) for exhaust of the inert gas from the chamber(s). If desired, the gas can be recirculated through a conduit (not shown) connected to the exhaust opening and to a suitable place on the housing for recirculation into the heating chamber. If the exhaust gas becomes depleted with off gases from the fibers or fiber tow, it can be discharged or combined with fresh inert gas. The velocity of the gas should be controlled since, at the higher rates of flow, the turbulence that can be created by the inert gas can cause an excessive movement of the fiber or fiber tow as it passes through the housing. Such excessive movement can place a stress on the fiber or stretch the fiber sufficiently to reduce or eliminate the temporary crimp in the fiber.

The residence time of the fibers or fiber tow in the heating zone is dependent upon the particular polymeric material of the fibers utilized, the diameter of the fiber, the degree of carbonization desired, and the temperature(s) utilized.

The carbonaceous fibers of this invention have an LOI value of greater than 40 when the fibers are tested according to the American Standard Test Method ASTM D 2863-77. The test method is also known as the "oxygen index" or "limited oxygen index" (LOI). With this procedure the concentration of oxygen in $O_2/N_2$ mixtures is determined at which a vertically mounted specimen is ignited at its upper end and just barely continues to burn. The width of the specimen is from 0.65 to 0.3 cm with a length of from 7 to 15 cm. The LOI value is calculated according to the equation:

$$LOI = \frac{[O_2]}{[O_2] + [N_2]}$$

The carbonaceous fiber of the invention is prepared by heat treating a suitable stabilized or oxidized polymeric precursor fiber which is provided with crimps of a relatively high frequency in an inert atmosphere and without subjecting the fibers to tension or stress, thereby increasing the carbon content in the fiber forming a substantially irreversibly heat set fiber. Preferably, the stabilized precursor material used in the present invention is derived from oxidatively stabilized polyacrylonitrile (PAN) filaments.

Polymeric precursor materials such as stabilized acrylic filaments which are advantageously utilized in preparing the carbonaceous fibers of the invention are selected from one or more of the following: acrylonitrile based homopolymers, acrylonitrile based copolymers and acrylonitrile based terpolymers. The copolymers preferably contain at least about 85 mole percent of acrylonitrile units and up to 15 mole percent of one or more monovinyl units.

Examples of other vinyl monomers copolymerizable with acrylonitrile include methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; and vinylsulfonic acid and the salts thereof.

The preferred precursor materials are typically prepared by melt spinning, dry or wet spinning the precursor material in a known manner to yield a monofilament or multifiber tow. The fiber or tow are then heated to a temperature and for a period of time as described in U.S. Pat. No. 4,837,076 or as modified in the present invention.

The polyacrylonitrile (PAN) based fibers can be formed by conventional methods such as by melt, dry or wet spinning a suitable liquid of the precursor material. The polyacrylonitrile (PAN) based fibers which have a normal nominal diameter of from 4 to 25 micrometers are collected as an assembly of a multiplicity of continuous filaments in tows. The fibers are then stabilized, for example by oxidation, or any other conventional method of stabilization. These stabilized fibers typically have an elongatability of from about 1.25 to about 1.9%. The stabilized fibers or tows, which are typically made from chopped or stretch broken fiber staple, are crimped and thereafter heat treated according to the present invention, in a relaxed and unstressed condition, at elevated temperatures in an inert non-oxidizing atmosphere for a period of time to produce a heat induced thermoset reaction. A nitrogen content of from about 5 to about 35% is maintained when a non-graphitic fiber is desired.

It is to be understood that the fiber or fiber tow can be initially heat treated at the higher range of temperatures for a time period depending on the degree of carbonization desired so long as the heat treatment is conducted while the fiber is in a relaxed or unstressed state and under an inert, nonoxidizing atmosphere including under a reduced pressure atmosphere. Preferably, the stabilized polymeric precursor fiber is also prepared without the application of stress or strain.

As a result of the higher temperature treatment of 525° C. and above, a substantially permanent or irreversible heat set is imparted to the fiber or tow.

Stabilized linear polymeric precursor fibers can also be prepared from other well known materials such as pitch (petroleum or coal tar), polyacetylene, polyphenylene, polyvinylidene chloride, aromatic polyamides (KEVLAR®, a trademark of E. I. du Pont de Nemours & Co.), polybenzimide resin, SARAN® (trademark of The Dow Chemical Company), and the like.

It is understood that aromatic polyamide fibers, when heat treated at an elevated temperature for a period of time, are provided with an increase in carbon content, that is, the aromatic polyamide fibers are partially to complete carbonized as disclosed in U.S. Pat. No. 4,642,664. Specific examples of aromatic polyamides include polyparabenzamide and polyparaphenylene terephthalamide. Other wholly aromatic polyamides are poly(2,7-paraphenylene-2, poly(methyl-1,4-phenylene) terephthalamide.

The aromatic polyamide fibers of the invention are provided with a substantially heat set nonlinear configuration when heated in a crimped and nonstressed condition at a temperature above 200° C. preferably at a temperature of from 200° C. to 375° C. in a water free atmosphere. The period of time employed in heating the fibers depends on the temperature, size of fiber, type of aromatic polyamide, etc. A more permanent heat set is imparted when the fibers are heated at higher temperatures rendering the fiber more carbonaceous.

Stabilized or nonstabilized aromatic polyamide fibers which are provided with a nonlinear configuration when heat treated in crimped and unstressed condition and in an inert atmosphere, result in a stronger fiber with a more permanent crimp than the same fibers when heat treated in air.

The crimped carbonaceous acrylonitrile based fibers which are prepared according to this invention can be classified into four groups.

In a first group, the carbonaceous fibers are electrically nonconductive and possess no antistatic characteristics, i.e., they are not able to dissipate an electrostatic charge.

The term electrically nonconductive as utilized in the present invention relates to a resistance of greater than $4\times10^6$ ohms/cm when measured on a 6K (6000 filaments) tow of fibers having a single fiber diameter of from about 4 to about 20 microns and a nitrogen content of greater than about 18%.

When the fibers are stabilized and heat set acrylic fibers, it has been found that a nitrogen content of about 18% or higher results in electrically nonconductive fibers.

In a second group, the carbonaceous fibers are classified as being partially electrically conductive (i.e., the fibers have a relatively low electrical conductivity), nave static dissipating characteristics, have a carbon content of greater than 65% and a nitrogen content of from about 14 to about 18%. Low conductivity means that a 6K tow of fibers in which the precursor fiber have a single fiber diameter of from about 4 to about 20 microns, have a tow resistance of from about $4\times10^6$ to $4\times10^3$ ohms/cm. The preferred fibers of this group have an elongatability of from about 3 to about 6 percent.

In a third group are fibers having a carbon content of at least 85% but less than 92% so as to be nongraphitic, and a nitrogen content of at least 5%. These fibers are characterized as having a high electroconductivity and a specific resistivity of less than $10^{-1}$ ohm-cm.

In a fourth group of fibers are graphitic fibers which have an elemental carbon content of at least 92%, preferably 98%, and which have characteristics which are further defined in U.S. Pat. No. 4,005,183 to Singer. These fibers can be incorporated into various thermoplastics materials to lower their surface and volume resistivities so that they can dissipate electrostatic charges and attenuate electromagnetic signals (EMI shielding). It will be appreciated that the tenacity and elongatability of a fiber or fiber tow depends, to some extent, on the heat treatment of the fiber. Thus, fibers that are treated at lower temperatures, such as the fibers of groups 1 and 2, exhibit a superior tenacity and elongatability. Fibers that are treated at the higher range of temperatures, such as the fibers of groups 3 and 4 exhibit less tenacity and elongatability. Graphitic fibers are inherently brittle and exhibit even less tenacity and elongatability, but still represent a valuable and useful product that has many applications in industry.

The fibers of this invention can be used in substantially any desired fabricated form. The carbonaceous fibers can be stretch broken and formed by conventional equipment into roving, cord, rope or spun yarn. The spun yarn can be manufactured into woven or knitted cloth, carpets, blankets, and the like. Nonwoven structures can be manufactured into a wool like fluff or batting, sheeting, panel, paper, and the like. A wool like fluff or batting is particularly useful as a thermal insulating material.

The carbonaceous fibers of the invention can be used alone or blended with other synthetic or natural fibers. Examples of other fibers that can be used include linear and nonlinear fibers selected from natural or polymeric fibers, other carbon fibers, ceramic fibers, glass fibers, or metal or metal coated fibers. In particular, natural and/or synthetic polymeric fibers that are well adapted to be included into blends with the carbonaceous fibers of the invention are cotton, wool, polyester, polyolefin, acrylic, nylon, rayon, tetrafluoroethylene, polyamide, vinyl, and protein fibers. Other mineral fibers that can be blended with the carbonaceous fibers of the invention include fibers of silica, silica alumina, potassium titanate, silicon carbide, silicon nitride, boron nitride, boron, and oxide fibers derived from boron, thoria or zirconia.

Exemplary of the present invention are the following examples:

EXAMPLE 1

A 40k tow of oxidized polyacrylonitrile based precursor fibers, sold under the name PANOX by R. K. Textile Ltd., of Heaton-Noris, Stockport, England, and having a density of from 1.35 to 1.39 g/cc (gram per cubic centimeter) and containing at least 85 mole percentage of acrylonitrile units, is passed through a constant indexing fine crimp forming device to provide the tow with 12 crimps per inch. The crimp forming device comprises, as one component, a pair of floating, non-contacting crimping wheels with rounded teeth which form the crimp, and as another component an anti-backlash mechanism which drives each of the crimping wheels in constant synchronization, and which transfers the torque and compensates for the variable spacing of the wheels.

The crimped tow is passed onto a conveyer, without applying any stress or strain on the crimped tow, and then through a heated furnace maintained at a temperature of 650° C. The furnace is constantly purged with nitrogen in accordance with the procedure described in U.S. Pat. No. 4,857,394. The residence time in the furnace is 1.5 minutes. A tow is produced having partially carbonized fibers with an elongation of 3.0%, a pseudo-elongation of 0.5%, a reversible deflection ratio of about 1.0 to 1.06 and a tenacity of 5 g/d.

EXAMPLE 2

The procedure of Example 1 is repeated except that the furnace is modified so that nitrogen gas can be passed through the tow and out of the chamber. The nitrogen is emitted into the furnace at a flow rate of 13 $ft^3$/min., directly onto the tow as it passes over an outlet opening which removes the nitrogen and spent gases.

The fibers of the resulting tow have an elongation of 3.5%, a pseudo-elongation of 0.5%, a reversible deflection ratio of about 1.0 to 1.06, and a tenacity of 19 g/d.

EXAMPLE 3

Runs are made in a Lindberg Tube Furnace to convert gear crimped oxidized polyacrylonitrile fibers (OPF) to non-linear carbonaceous fibers. Samples of oxidation stabilized polyacrylonitrile yarn having a density of from 1.35 to 1.38 g/cc and having 6000 filaments per tow (6K) are crimped by first moistening the OPF and then heating to a temperature of from 90° to 100° C. just prior to running the fiber tow through a set of driven toothed crimping wheels each having a diameter of 2 in. and 96 teeth. The toothed wheels are selected so that there are no sharp edges on the teeth. Both wheels are synchronically driven using an anti-backlash gear which allows for a gap between the wheels of approximately the thickness of the tow. The gap is adjusted to provide a pressure on the fiber tow without causing any permanent damage to the fibers during the crimping process. The crimped OPF fiber tow is placed in a quartz boat. The boat and fibers are then placed inside a $N_2$ purged quartz tube and allowed to purge for 15 minutes to remove all air from the tube and fibers. The boat with the fibers is then moved into a heating zone in the furnace and held at a temperature of from 550° to 600° C. for a period of time of from 1.5 to 2 minutes. The boat and fibers is then removed from the hot zone of the furnace and the heat treated, permanently set, non-linear fibers are allowed to cool to a temperature below 100° C. while under a $N_2$ purge. A portion of the sample is blended with 50% polyester staple using a roller top card. Small amounts of fine spun yarn are also made. The samples readily pass the vertical burn test and the various fireblocking tests as listed in FAR 25.853.

EXAMPLE 3A

The procedure described in Example 3 is repeated except that the fibers are provided with a complex crimp in accordance with a further embodiment of the invention. After passing the fibers of Example 3 through the set of crimping wheels, they are passed through a second set of driven toothed crimping wheels. The second set of crimping wheels superimposed a larger size wave or crimp over the fine or higher frequency crimp without pulling out or obliterating the higher frequency crimps. The complex crimped fibers are deposited upon a moving conveyor belt, without applying stress or tension on the crimped fibers, and are then passed into a heating zone in a furnace and held at a temperature of from 550° to 600° C. for a period of time of from 1.5 to 2 minutes. During passage of the fibers through the heating zone, a constant flow of $N_2$ gas is passed throught the fibers. The fibers are then removed from the hot zone of the furnace and the heat treated, permanently set, fibers are allowed to cool to a temperature below 100° C. while under a $N_2$ purge. The fibers exhibited an irreversibly heat set complex crimp having a reversible deflection ratio of 1.15:1.

EXAMPLE 4

A. A sample (A) of a non-linear carbonaceous fibers prepared by a knit-deknit procedure in accordance with the process of U.S. Pat. No. 4,837,076, is heat treated to a temperature of about 550° C. for one minute. The fibers have an elongation of about 3% and a tenacity of 3 g/d. A 2.5 in. staple of the fibers are run through a roller and clearer card (sold by Davis & Ferber) to open the sample.

B. A sample (B) of fine crimped fibers of the invention having 9 crimps per inch is prepared and heat treated under the same conditions as in part A. The fibers have an elongation of about 3% and a tenacity of about 3 g/d. The sample is run on the roller and clearer card.

C. A sample (C) of fine crimped fibers of the invention having 9 crimps per inch is prepared and heat treated at a temperature of about 550° C., under the same conditions as in Example 2. The fibers have an elongation of 8% and a tenacity of 4 g/d. The sample is run on the roller and clearer card.

Results

The sample (A), as a result of poor cohesiveness had more fly and fall out than samples (B) and (C).

EXAMPLE 5

Hand slivers (0.3 g per 3 in.) are prepared from each of the samples of Example 4. Samples A and B are mounted on a 1225 Instron having a gauge length to 3 inches. Using a process speed of 2mm per min. and a 20 g load cell, each sliver is measured for force to pull apart the web made as it comes off from a card doffer so as to determine their cohesiveness.

Results

| Sample A | Sample B | Sample C |
|---|---|---|
| 3.8 g | 11.8 g | 12.1 g |

The fibers of samples B and C have approximately three times the cohesive force of sample A.

EXAMPLE 6

Samples of the fibers of Examples 1 and 3 are blended with a 60% KODEL 435, a polyester staple fiber, on a randomizing card. The blended fibers are then placed in a Rando B non-woven web former and a 4 oz. per square yard non-woven batting is produced. The resulting batting is tested and exhibited fire resistant characteristics. The batting passed the vertical burn test according to FTM-5903 and FAR25.853b.

EXAMPLE 7

A 1500 denier tow of stabilized-p-aramid fibers is crimped following the procedure of Example 2 and heated to a temperature of 275° C., under a nitrogen purge. The heat treatment is conducted over a period of 10 minutes. When cooled, the tow is opened. The fibers contain 12 heat set crimps which could not be removed by stretching the fiber or by heating with a conventional hair dryer.

The invention which is intended to be protected is not to be construed as limited to the particular embodiments disclosed herein since these are to be regarded as illustrative. Variations and changes which can readily be made by those skilled in the art without departing from the scope of invention are included herein.

What is claimed is:

1. A non-linear fire resistant carbonaceous fiber or tow of fibers, said fiber having a reversible deflection ratio equal to or less than 1.2:1, and a pseudo-elongatability of from about 0.2 to 18%.

2. The fiber of claim 1, having an elongatability of from about 2 to 9%.

3. The fiber of claim 1, having a pseudo-elongatability of from about 0.2 to about 10%.

4. The fiber of claim 1, having a crimp frequency of from about 6 to about 15 crimps per inch.

5. The fiber of claim 1, having a bending strain value of less than 50%.

6. The fiber of claim 1, having a tenacity of from about 6 to about 13g/d.

7. The fiber of claim 1, having a tenacity of from about 13 to about 19 g/d.

8. The fiber of claim 1, wherein said carbonaceous fiber is derived by heat treating a p-aramid fiber.

9. The fiber of claim 1, wherein said fiber is a graphitic fiber having a carbon content of at least 92%.

* * * * *

UNITED STATES PATENT AND TRADEMARK OFFICE

CERTIFICATE OF CORRECTION

PATENT NO. : 5,356,707

DATED : October 18, 1994

INVENTOR(S) : Francis P. McCullough, Jr. et al.

It is certified that error appears in the above-identified patent and that said Letters Patent is hereby corrected as shown below:

In column 14, line 6, under claim 1, "pseudo-elongatability", should read --pseudoelongatability--.

In column 14, line 9, under claim 2, after "from about 2 to", insert --about--.

Signed and Sealed this

Second Day of April, 1996

Bruce Lehman

BRUCE LEHMAN

*Commissioner of Patents and Trademarks*

*Attest:*

*Attesting Officer*